US006144303A

United States Patent [19]

Federman

[11] Patent Number: 6,144,303

[45] Date of Patent: Nov. 7, 2000

[54] TAG AND SYSTEM FOR PATIENT SAFETY MONITORING

[75] Inventor: Vladimir Federman, Winnipeg, Canada

[73] Assignee: EXI Wireless Systems, Inc., Canada

[21] Appl. No.: 09/241,218

[22] Filed: Feb. 1, 1999

[51] Int. Cl.[7] ..... G08B 21/02

[52] U.S. Cl. ..... 340/573.4; 340/539; 340/568.1; 340/573.1

[58] Field of Search ..... 340/573.4, 573.1, 340/539, 568.1

[56] References Cited

U.S. PATENT DOCUMENTS

| | | | |
|---|---|---|---|
| 3,012,193 | 12/1961 | Breen | 324/668 |
| 3,723,885 | 3/1973 | Urmenyi | 307/652 |
| 3,764,861 | 10/1973 | Orris | 361/181 |
| 4,030,037 | 6/1977 | Tanaka et al. | 307/652 |
| 4,053,789 | 10/1977 | Schultz | 307/116 |
| 4,173,755 | 11/1979 | Butler | 340/562 |
| 4,293,852 | 10/1981 | Rogers | 340/568.1 |
| 4,320,766 | 3/1982 | Alihanka et al. | 600/484 |
| 4,348,662 | 9/1982 | Fontaine et al. | 340/562 |
| 4,558,309 | 12/1985 | Antonevich | 340/649 |
| 4,598,275 | 7/1986 | Ross et al. | 340/573.4 |
| 4,675,659 | 6/1987 | Jenkins, Jr. et al. | 340/573.1 |
| 4,885,571 | 12/1989 | Pauley et al. | 340/573.4 |
| 5,541,580 | 7/1996 | Gerston et al. | 340/573.4 |
| 5,689,240 | 11/1997 | Traxler | 340/573.4 |

*Primary Examiner*—Glen Swann
*Attorney, Agent, or Firm*—Biper Marbury Rudnick & Wolfe

[57] ABSTRACT

The tag includes: a tag for monitoring the security of a patient, the tag comprising, a housing having a wall, the wall having an inner surface and an outer surface, an electronic circuit located in the housing, the electronic circuit including an alarm circuit, including a capacitance measuring circuit, the capacitance measuring circuit having first and second electrodes, the first and second electrodes located adjacent the inner surface and in spaced relation from one another to form a capacitor, the alarm circuit having means for generating an alarm signal upon the capacitance measuring circuit detecting a level of capacitance corresponding to an alarm condition, whereby the outer surface of the housing is placed in contact with the patient, with the first and second electrodes capacitively coupled to the patient, but without the first and second electrodes in physical contact with the patient, the capacitance measuring circuit detects an alarm condition when the patient is no longer in contact with the outer surface of the tag.

27 Claims, 7 Drawing Sheets

TAG AND SYSTEM FOR PATIENT SAFETY MONITORING

FIELD OF THE INVENTION

The present invention relates to tags and a system for patient safety and security, and in particular for monitoring the movement of a patient outside of a protected area of a hospital or other patient facility.

BACKGROUND

There are many situations where the safety of a patient requires monitoring the movement of the patient within a hospital or other type of patient facility. Typically, the patient is unable to protect themselves and provide for their own safety. For example, individuals suffering from some form of mental illness may require hospitalization for a variety of reasons. Such individuals are usually unrestrained. However, there is a concern that the individual may attempt to leave the facility or enter an area which may be hazardous to their well-being or the well-being of others. As a further example, it is unfortunately necessary to protect newborns and infants from being kidnapped. In addition to the safety and security of a patient, such entities, and the individuals managing such entities, have a responsibility to provide for the reasonable protection of patients under their care.

Security personnel are often employed to assure that individuals leaving or entering the premises are authorized to do so. Typically, the entrance and exists of facilities are staffed with security personnel. Hallways and other locations may also be patrolled by security personnel. In addition, video cameras may be strategically located throughout the facility and provide a video feed to a central monitoring system. The central monitoring system may be monitored by security personnel or other staff members.

It is also known to secure tags to individuals. U.S. Pat. No. 4,885,571 (PAULEY et al.) discloses a tag for use with a system for monitoring an individual. Two capacitive electrodes, one of which is realized as a conductive strap that attaches the tag to the individual and the other as a plate within the tag itself, function as the plates of capacitor, with the body flesh serving as the dielectric material therebetween. An oscillator signal is applied to strap and is received by the tag plate through the body flesh. A switch is connected to the tag plate. The switch is activated as long as the body remains between the strap and the tag plate. If the strap is removed, however, the switch is not activated and a tamper signal is sent to encoding circuitry. The encoding circuitry works with other tag circuits so that an identification signal is periodically transmitted. This signal includes information such as an indication that the tag has been removed from the individual.

U.S. Pat. No. 5,541,580 (GERSTON et al.) shows a tag for detecting a body. The device uses a plate in a tag as a first electrode and, as a second electrode, a strap that holds the tag to the wearer's wrist or ankle. The wearer's wrist of ankle serves as the dielectric between the two electrodes so that a capacitor is formed. See item 20 in FIG. 1. The capacitance of this capacitor is measured to establish a range of acceptable values. The range of acceptable values are based upon the theory that slowly occurring and minor capacitance changes are normal while illegitimate activities, such as complete removal of the tag, result in rapid and large capacitance changes. As described in col. 5, lines 56–67 and col. 6, line 1, the circuit of FIG. 4 may be used to make required measurements. More specifically, as shown in FIG. 4, the capacitor 20 is connected to a signal generator 60 that includes an inverting circuit 62 with a resistor 64 coupling between the input and output thereof. As a result, signal generator 60 produces a signal that oscillates at a frequency that varies in response to the capacitance of capacitor 20 and the dielectric constant in region 26 (FIG. 1).

U.S. Pat. No. 4,293,852 (ROGERS) shows a capacitive article removal alarm capable of detecting when an article is removed from a predetermined position. The device is particularly suited for use in the prevention of shoplifting. The protected article is either metallic, incorporates metal near its base or carries a sticker tag that incorporates metal. The article is positioned so as to overlie a pair of electrode strips which communicate with a sensing circuit. The sensing circuit features an oscillator and is configured to go into and out of oscillation by the change of capacity occurring between the electrode strips. The sensing circuit also features a variable capacitor that is adjusted so that the oscillator is just not oscillating when the protected article is placed in position. As a result, when the article is removed from its position, the capacitance across the electrode strips decreases and the oscillator starts working. An alarm circuit receives the oscillating output from the sensor circuit and triggers an alarm such as a bell.

There are various problems and deficiencies in the prior art tags. For instance, the prior art does not disclose a tag which provides satisfactory isolation between the individual and the electrical circuit. In addition, the prior art tags have large current requirements. The prior art tags also have a short useful life without maintenance.

SUMMARY OF THE INVENTION

It is an object of the present invention to provide an improved tag and system for the monitoring of patient safety.

It is an object of the present invention to provide a patient safety tag which provides satisfactory electrical isolation between the individual and the electrical circuit of the tag.

It is a further object of the present invention to provide a patient monitoring tag which is water-resistant.

It is a further object of the present invention to provide a low cost and easily manufactured tag for monitoring patient safety.

It is a further object of the present invention to provide patient monitoring tag having a long useful service life without the need of maintenance.

It is a further object of the present invention to provide a patient monitoring tag which includes economical power consumption features.

BRIEF DESCRIPTION OP THE DRAWINGS

Figure 1:
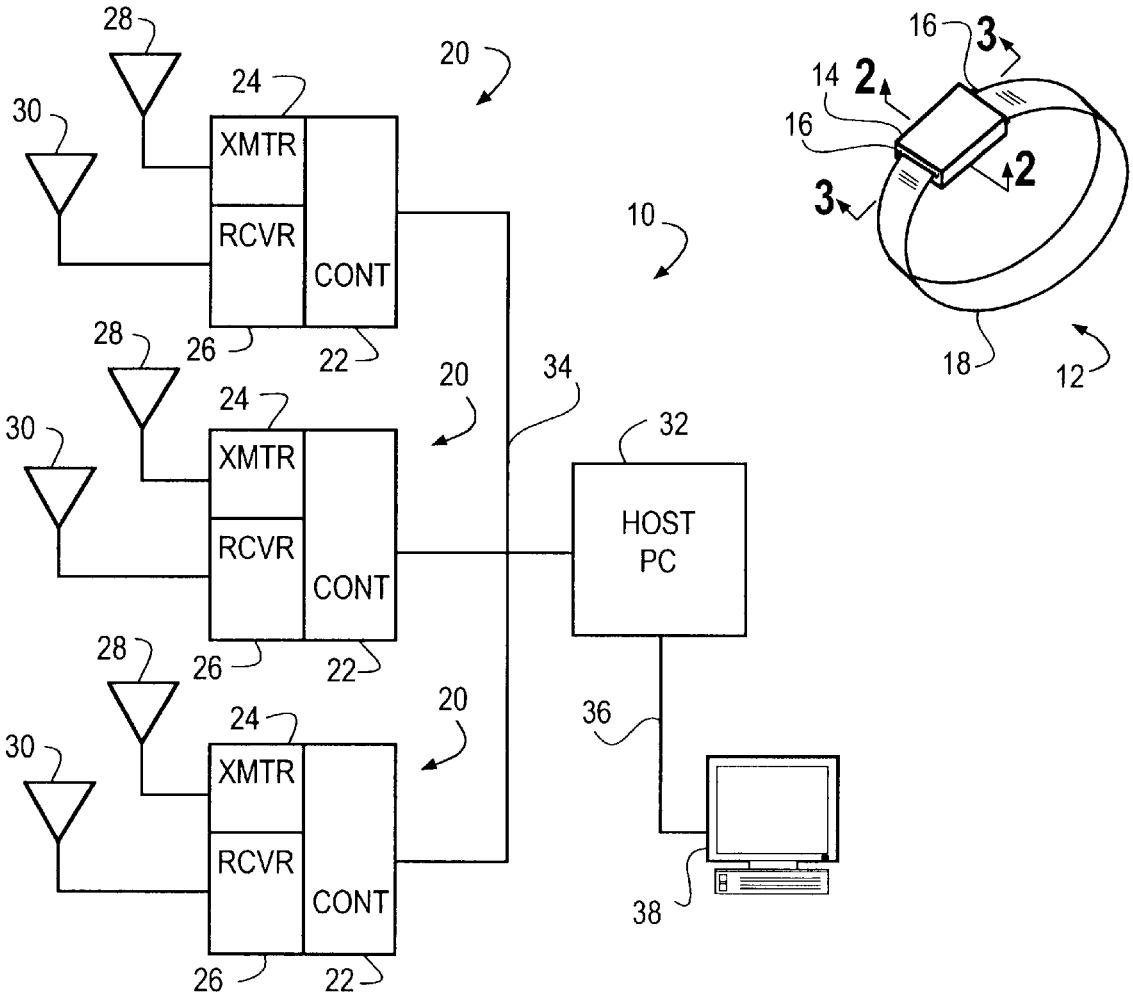
FIG. 1 shows a monitoring system including the tag of the present invention.

DESCRIPTION OF PREFERRED EMBODIMENT OF THE INVENTION:

FIG. 1 shows a system 10 for patient safety monitoring. The system 10 includes a tag 12 having a housing 14. The housing 14 includes a wristband fastener portion 16 extending from two opposing sides of the housing 14. A wristband 18 is secured to the tag 12 by means of the wristband fastener portions 16. The system 10 shown in FIG. 1 also includes tag monitors 20. Each tag monitor 20 includes a controller 22, transmitter 24, receiver 26, transmitter antenna 28 and receiver antenna 30. Each of the monitors 20 are coupled to a host PC 32 via a network 34. The host PC 32 includes a cable 36 for coupling to a central security monitor 38.

Figure 2:
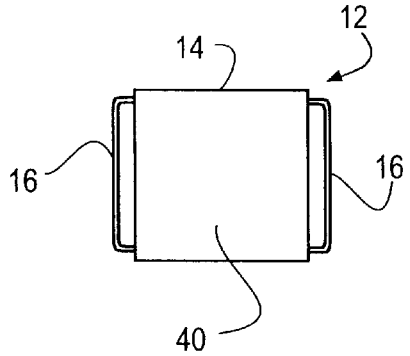
FIG. 2 shows a bottom view of the tag, without the wrist band, taken along line 2—2 of FIG. 1
Figure 3:
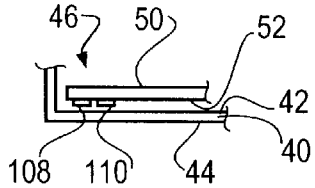
FIG. 3 shows a partial view of a cross-section of the tag taken along line 3—3 of FIG. 1

FIG. 2 shows the bottom view of the tag 12, from which can be seen the bottom wall 40. The wall 40 includes an inner surface 42 and an outer surface 44 as seen in FIG. 3. Within the housing 14 is located a printed circuit board (PCB) 46 providing the electronic circuit 48 for the tag 12. The PCB 46 includes a component side 50 and a foil side 52.

Figure 4:
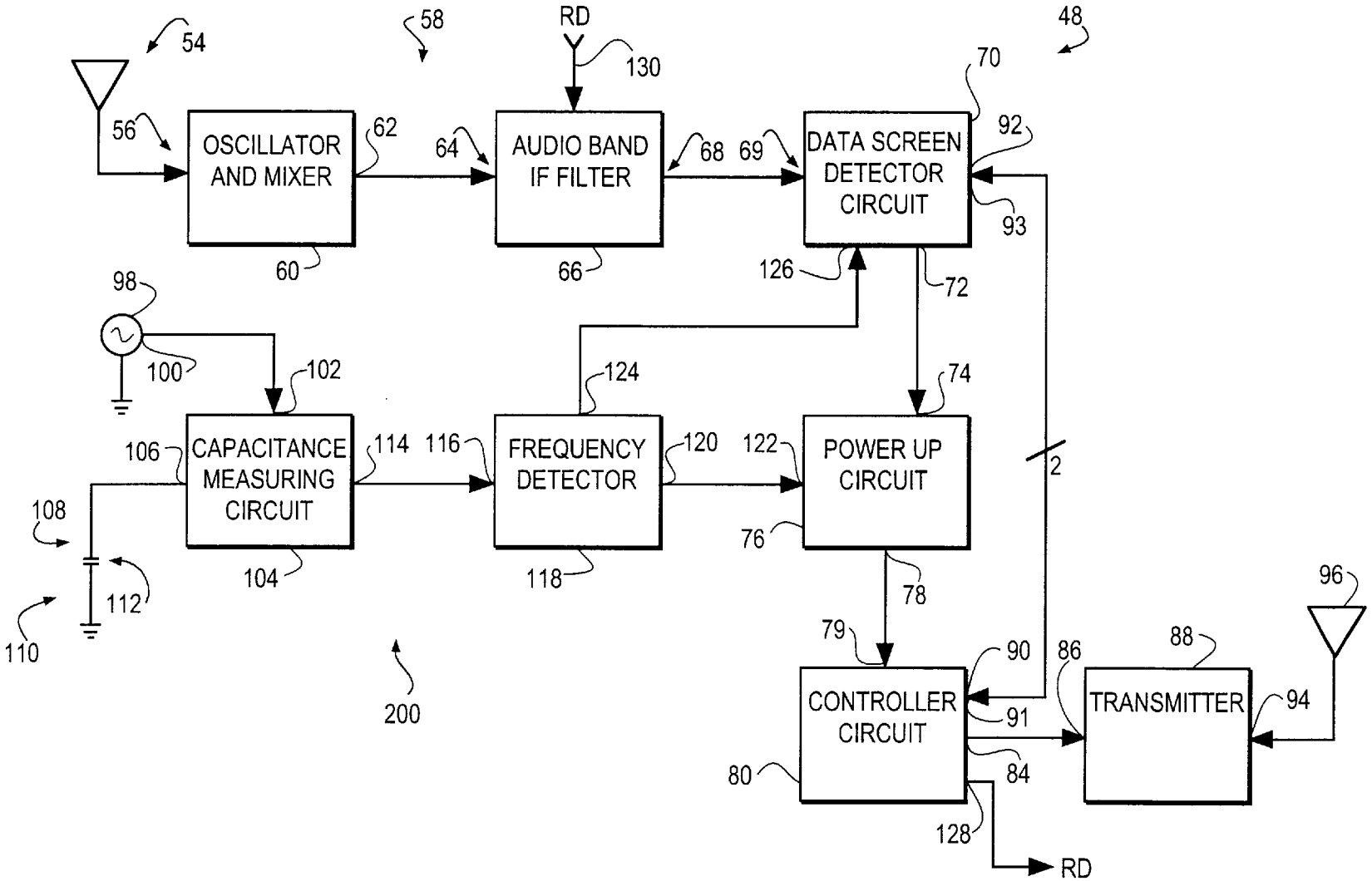
FIG. 4 shows a block diagram of the tag of the present invention.

FIG. 4 shows a block diagram of the electronic circuit 48. The electronic circuit 48 includes a receiver antenna 54 coupled to the input 56 of a receiver 58. The receiver 58 includes an oscillator and mixer 60 having an output 62 coupled to the input 64 of an audio band IF filter 66. The output 68 of the receiver 58 is coupled to a first input 69 of a data stream detector circuit 70. The data stream detector circuit 70 includes an output 72 coupled to a first input 74 of a power up circuit 76. The power up circuit 76 includes an output 78 coupled to an input 79 of a controller circuit 80. The controller circuit 80 includes a microprocessor 82. The controller circuit 80 also includes a first output 84 coupled to the input 86 of a transmitter 88 and second and third outputs 90,91 coupled to respective second and third inputs 92, 93 of the data stream detector circuit 70. The transmitter 88 includes an output 94 coupled to a transmitter antenna 96. An oscillator 98 is shown to include an output 100 coupled to the power input 102 of a capacitance measuring circuit 104. The signal developed at the output 100 of the oscillator 98 is preferably in the range of 1–10 hertz with a 50% duty cycle. The capacitance measuring circuit 104 includes an input 106 coupled to a first electrode 108. A second electrode 110 is coupled to a ground potential or other reference. The first electrode 108 and second electrode 110 are located on the foil side of the PCB 46 and form a capacitor 112. The output 114 of the capacitance measuring circuit 104 is coupled to the input 116 of a frequency detector 118. The first output 120 of the frequency detector 118 is coupled to a second input 122 of the power up circuit 76. The second output 124 of the frequency detector 118 is coupled to a third input 126 of the data stream detector circuit 70.

The controller circuit 80 also includes an output 128 which is coupled to an input 130 of the receiver 58.

Figure 5A:
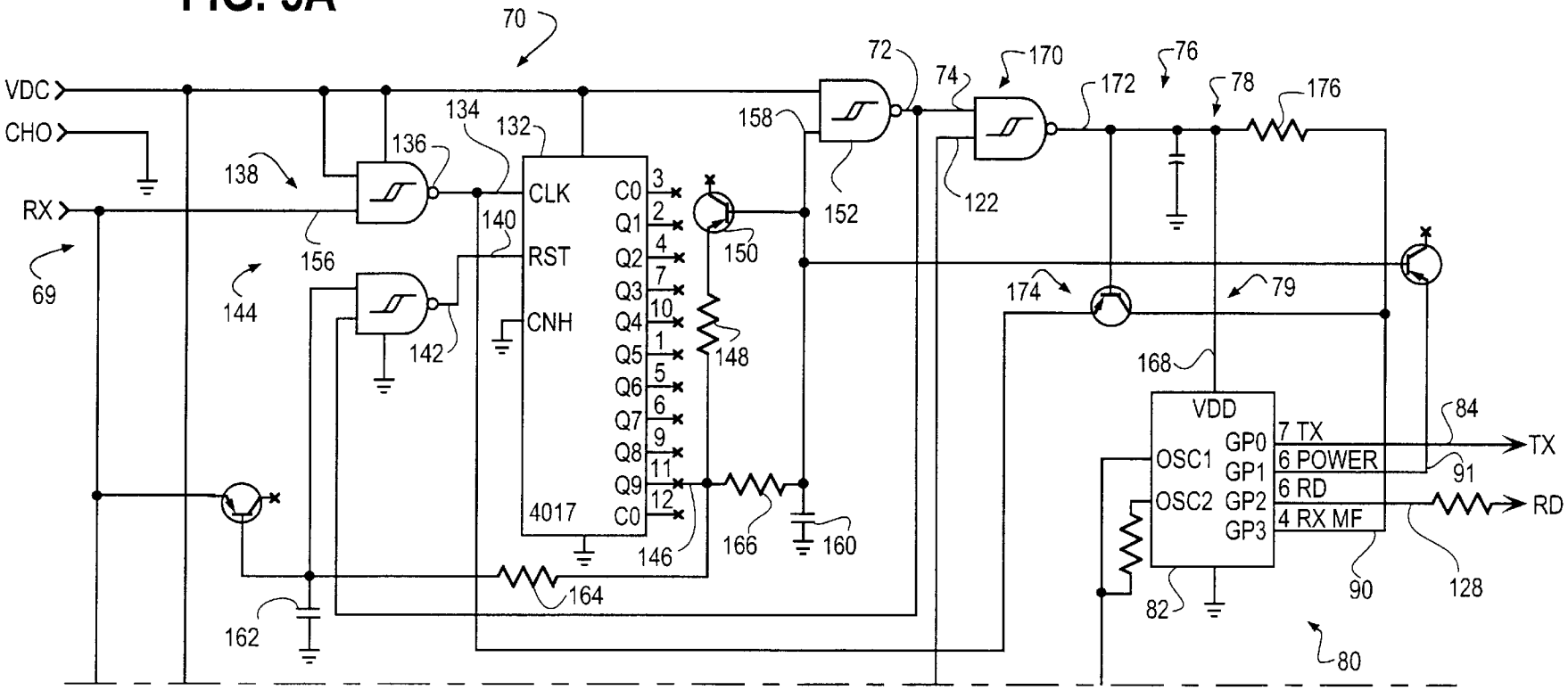
FIG. 5 and 6 show a schematic drawing of the block diagram shown in FIG. 4
Figure 5B:
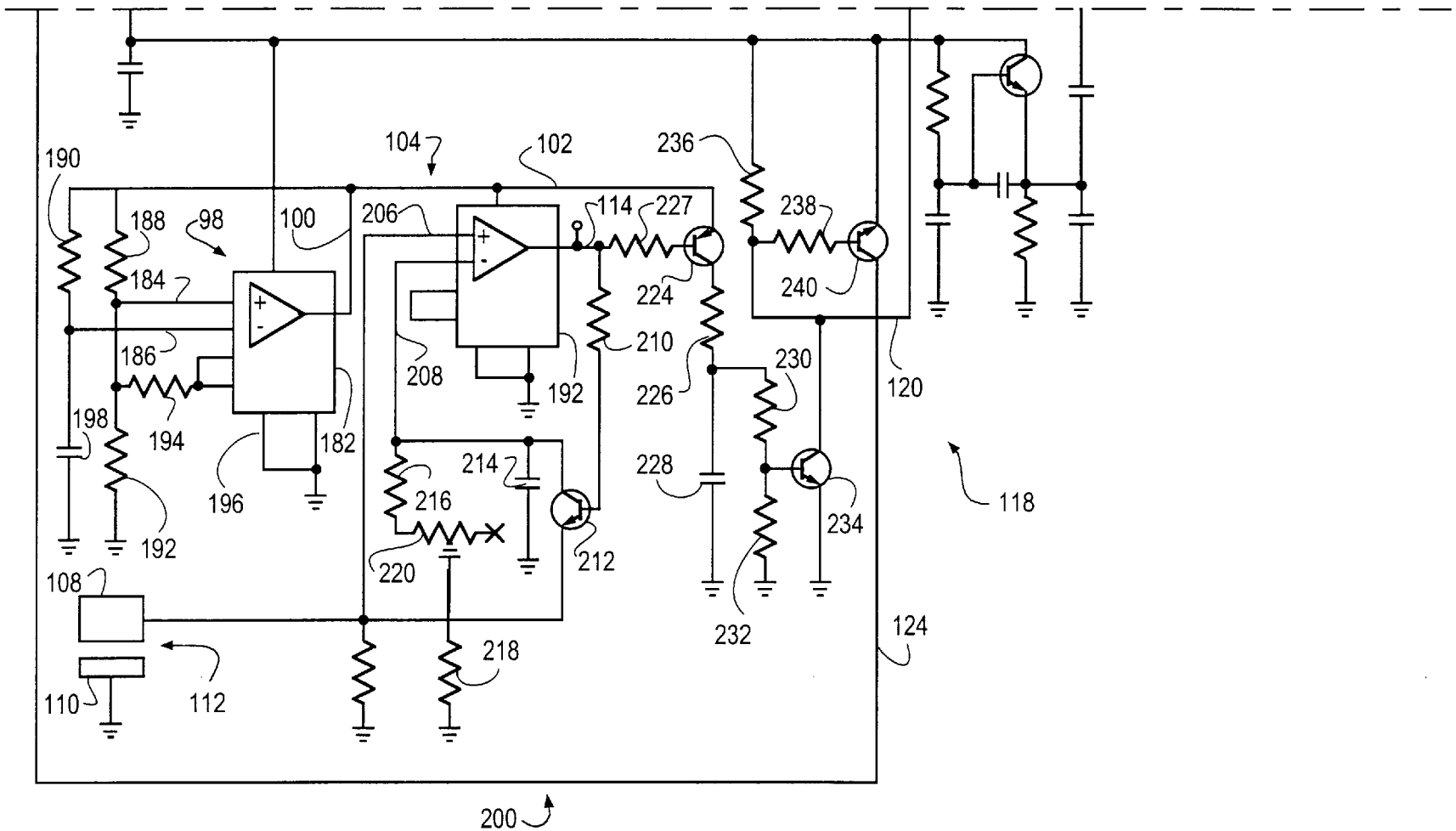

FIG. 5 provides a schematic of the digital portion of the electronic circuit 48. FIG. 5 shows the data stream detector circuit 70 includes a counter 132. The counter 132 includes a clock input 134 coupled to the output 136 of a NAND gate 138, a reset input 140 coupled to the output 142 of a NAND gate 144, and an output 146. The output 146 is coupled to a circuit which includes a resistor 148, transistor 150, and a NAND gate 152. The data stream detector circuit 70 is capable of detecting a predetermined data stream 154 (see FIG. 7) or power up signal at the input 156 of the NAND gate 138. The input 156 of the NAND gate 138 is coupled to the output 68 of the receiver 58. The predetermined data stream 154 is typically a burst of a certain number of pulses followed by a period of silence. The signal may be modulated. The data stream detector circuit 70 is tuned to detect a specific number of pulses in a row. The specific number of pulses detected is determined by which output O0–O9 is chosen as the detector output 146. These pulses have a certain maximum time from one to the next, within a burst. The burst is followed by a minimum time of silence. The timing is achieved by an RC network. If all of these criteria are met, the output 146 of the counter 132 will produce a logic high signal.

The logic high signal is coupled to the input 158 of the NAND gate 152 causing the output 72 of the NAND gate 152 to switch to a logic low signal. The logic low signal represents that a predetermined data stream 154 has been detected. However, the logic low level signal at the output 72 of the NAND gate 152 will change as soon as the capacitor 160 discharges the logic high level at the input 158 of the NAND gate 152.

The following is a more detailed description of the operation of the data stream detector 70. A signal from the receiver 58 is fed into the input 69. With the leading edge of the signal, the capacitor 162 charges and NAND gate 144 removes the reset condition from the counter 132. If the next pulse does not arrive within some specified time, the capacitor 162 discharges thru resistor 164 and the counter 132 will be back in the reset state. After bringing the counter 132 out of the reset, the counter 132 is advanced by one with the trailing edge of the first pulse. This process is repeated with the subsequent pulses within the burst, until the counter 132 reaches the predetermined count (which is 9 in this embodiment). If there are no other pulses after the $9^{th}$ pulse, a positive voltage on the output 146 will charge the capacitor 160 thru the resistors 148, 166. The time necessary to charge capacitor 160 is the minimum time of silence between the bursts. Once capacitor 160 is charged a logic high signal is applied to the input 158 of the NAND gate 152 which develops a logic low signal at the output 72 which is also the output 72 of the data stream detector 70.

If the incorrect number of pulses is received, the NAND gate 152 will not develop the logic low signal. For instance, if more than 9 pulses are received, the counter 132 rolls over and the output 146 of the counter 132 is switched before the capacitor 160 is able to charge sufficiently to provide a high level signal to the input 158 of the NAND gate 152. In the event that less than 9 pulses are received, the output 146 of the counter 132 will not switch to a logic high signal and the NAND gate 144 will reset the counter 132.

The output 72 of the data stream detector circuit 70 is coupled to a first input 74 of a power up circuit 76. The output 78 of the power up circuit 76 is coupled to the VDD power input 168 of the microprocessor 82. The power up circuit 76 also includes the second input 122. The first and second inputs 74,122 correspond to first and second inputs 74,122 of a NAND gate 170. When the first input 74 of the NAND gate 170 receives the logic low level signal from the output 72 of the detector 70, the output 172 of the NAND gate 170 will switch to a logic high signal which is coupled directly to the VDD power input 168 of the microprocessor 82 to power up the microprocessor 82. However, as soon as the capacitor 160 discharges the logic high level at the input 158 of the NAND gate 152, the output 72 of the detector 70 will switch to a logic high signal causing the output 172 of the NAND gate 170 to switch to a logic low signal. The logic low signal at the output 172 of the NAND gate 170 will cause the microprocessor 82 to power down. To prevent the microprocessor 82 from being powered down, the microprocessor 82 includes an initial power up routine which causes the output 91 of the microprocessor 82 to develop a logic high level signal which is coupled to the input 158 of the NAND gate 152 to maintain the power up condition of the microprocessor 82. The "diode" 174 together with the pull up resistor 176 are used to isolate the clocking signal from the microprocessor 82 during the power down time, and to deliver a signal to the microprocessor 82 during the power up. The microprocessor 82 includes an output 84 identified as "TX" and an output 128 identified as "RD". The TX output 84 is coupled to the input 86 of the transmitter 88.

FIG. 5 also shows that the oscillator 98 includes a comparator 182 having a non-inverting input 184 and an inverting input 186 and the output 100. The resistor 188 is coupled between the output 100 of the comparator 182 and the non-inverting input 184 of the comparator. A resistor 190 is coupled between the output 100 of the comparator 182 and the inverting input 186. The non-inverting input 184 is also coupled through a resistor 192 to ground and a resistor 194 coupled to a voltage reference 196. The inverting input 186 is also coupled to ground via a capacitor 198. The output 100 of the comparator 182 develops a signal preferably within the range of 1–10 hertz with a 50% duty cycle. The output of the comparator 100 comprises of the output 100 of the oscillator 98. The output 100 of the oscillator 98 provides the power source for a portion of the alarm circuit 200. The alarm circuit 200 includes the capacitance measuring circuit 104 and the frequency detector 118. The nature of the output of the oscillator 98 reduces the power consumption of the alarm circuit 200.

The capacitive measuring circuit 104 includes a comparator 202 having two identical feedback branches from the output 114 of the comparator 202 to the non-inverting input 206 and the inverting input 208. The capacitive measuring circuit 104 also includes the capacitor 112 formed by the first electrode 108 and the second electrode 110. The second electrode 110 is coupled to a ground reference. The first branch is formed by the resistor 210, transistor 212 and the capacitor 112. The second branch is formed by the resistor 210, transistor 212, and capacitor 214. Resistor 216, resistor 218 and potentiometer 220 are used to adjust the zero offset. If the RC time constant of the non-inverting branch is slightly larger than the RC time constant of the branch of the inverting input 208, the circuit will be unstable and will oscillate. On the other hand, if the RC time constant of the inverting branch is slightly larger than the RC time constant of the branch feeding the non-inverting input 206, the circuit will be stable and there will be no oscillations at the output 114 of the comparator 202. The output 114 of the comparator 202 provides the output 114 of the capacitive measuring circuit 104 and is coupled to the input 116 of the frequency detector 118. The frequency detector 118 includes the resistor 222, transistor 224, resistor 226, capacitor 228, resistor 230, resistor 232, transistor 234, resistor 236, resistor 238, and transistor 240. The frequency detector 118 provides the output 120 from the collector of the transistor 234 and the output 124 from the collector of the transistor 240. The first output 120 is coupled to the input 122 of the NAND gate 170 of the power up circuit 76. In the event the frequency detector 118 detects an oscillating signal at the output 114 of the capacitive measuring circuit 104, the first output 120 of the frequency detector 118 will switch to a logic low state causing the output 172 of the NAND gate 170 of the power up circuit 76 to switch to a logic high state. Once again, the switching of the output 172 of the NAND gate 170 to a logic high state provides power to the controller circuit 80 and initiates a power up routine. The microprocessor 82 will switch the output 91 to a logic high level. The logic high level is coupled to the input 158 of the NAND gate 152 of the data stream detector circuit 70, causing the output 72 of the NAND gate 152 to switch to a logic low level which in turn causes the output 172 of the NAND gate of the power up circuit to maintain a high logic level at the output 172. After the microprocessor 82 initiates the power up routine, the microprocessor 82 determines whether the power up was caused by the detection of a capacitance alarm or the detection of the predetermined bit stream 154. The microprocessor 82 then transmits data from the TX output 84. The data includes a tag identification, and an alarm signal in the event of a capacitance alarm detection.

Figure 6:
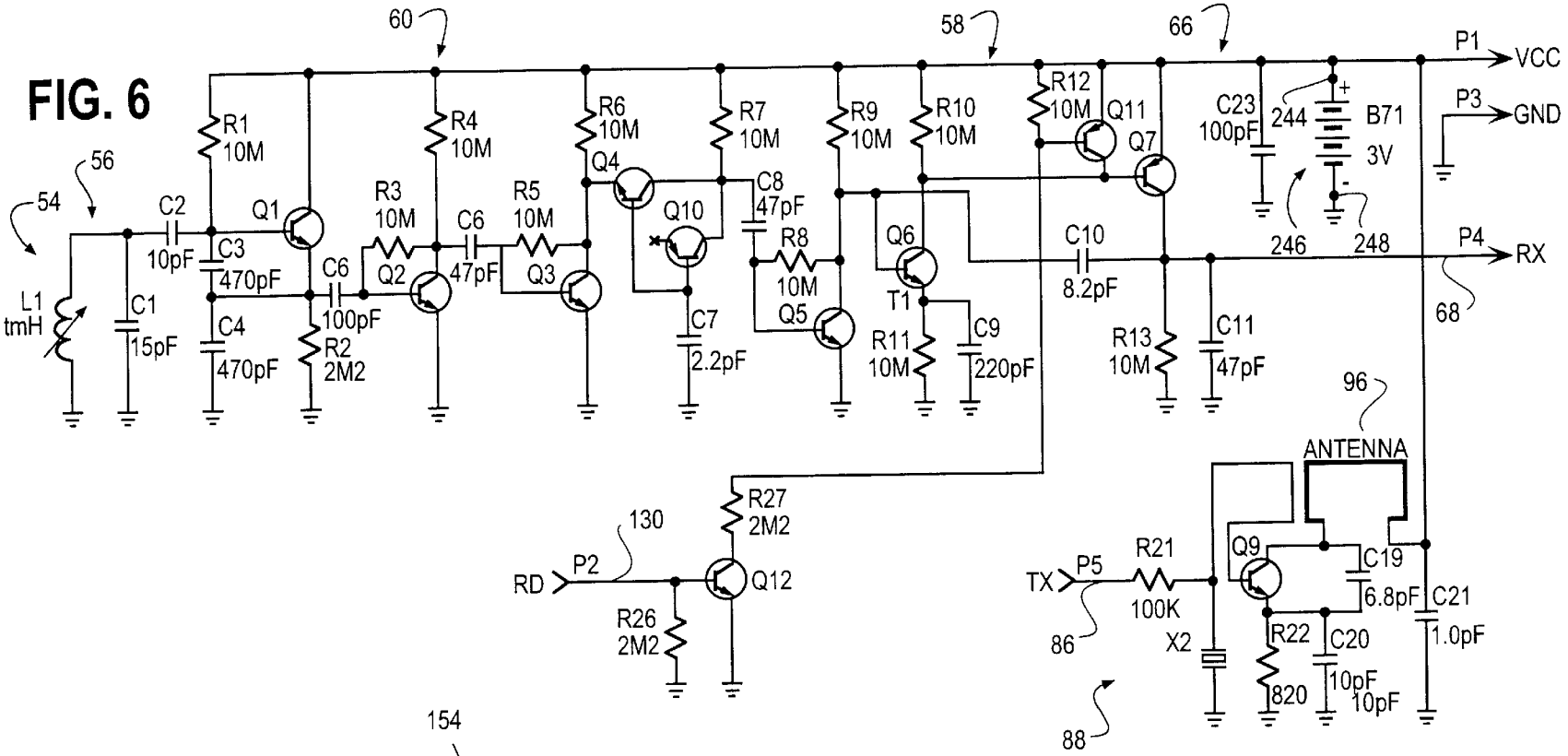

FIG. 6 shows the schematic for the receiver 58 and transmitter 88. The transmitter 88 is shown in the lower right portion of FIG. 6. The transmitter 88 includes an input 86 labeled "TX" which is coupled to the TX output 84 of the microprocessor 82. The data from the TX output 84 is transmitted via the transmitter antenna 96. The receiver 58 includes the receiver antenna 54 shown in the upper left portion of FIG. 6. The data received from the receiver antenna 54 is developed at the receiver output 68 which is coupled to the input 156 of the NAND gate 138 of the data stream detector circuit 70. The receiver 58 also shows an RD input 130 which is coupled to the RD output 128 of the microprocessor. 82. FIG. 6 also shows the battery terminals 244, 246 for connection to the battery 248. The battery 248 is preferably a lithium type battery.

Figure 7:
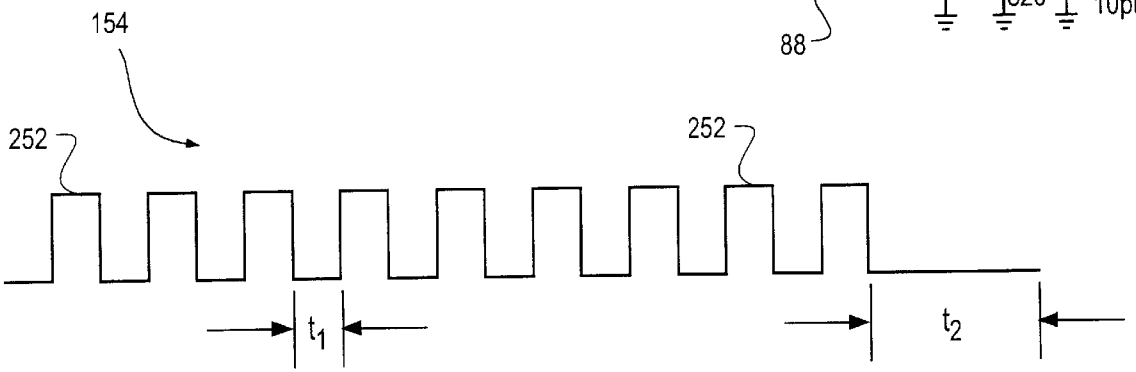
FIG. 7 shows the individual pulses of a predetermined data stream.

FIG. 7 shows the predetermined data stream which the data stream detector circuit 70 is tuned to detect. The predetermined data stream 154 includes nine pulses 252. There is a minimum time period $t_1$ between each pulse corresponding to the tuned data stream detector circuit 70. The predetermined data stream 154 also has a minimum time period $t_2$ of silence after the nine pulses.

Figure 8:
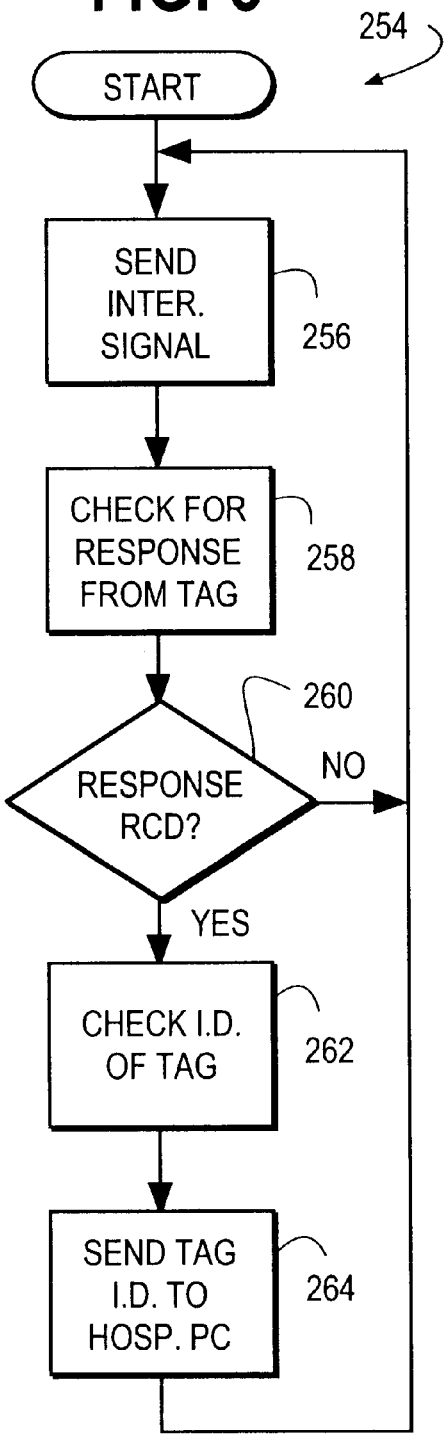
FIG. 8 is a flow chart of the monitor interrogation routine.

FIG. 8 shows the monitor interrogation routine 254. The routine begins at Step 256 with the monitor sending a RF interrogation signal. The interrogation signal includes the predetermined data stream. The interrogation signal is sent as a general broadcast for receipt by any tags within receiving distance and having a data stream detector circuit tuned to the predetermined data stream. The next Step 258 of the routine 254 checks for a response from a tag. Step 260 determines whether a response was received. In the event the response is not received, the routine 254 repeats the process. In the event a response is received, the next Step 262 of the routine 254 checks the signal received from the tag for the identification information of the tag. In the next Step 264, the routine sends the identification of the tag to the host PC. Thereafter, the routine 254 repeats the process.

Figure 9:
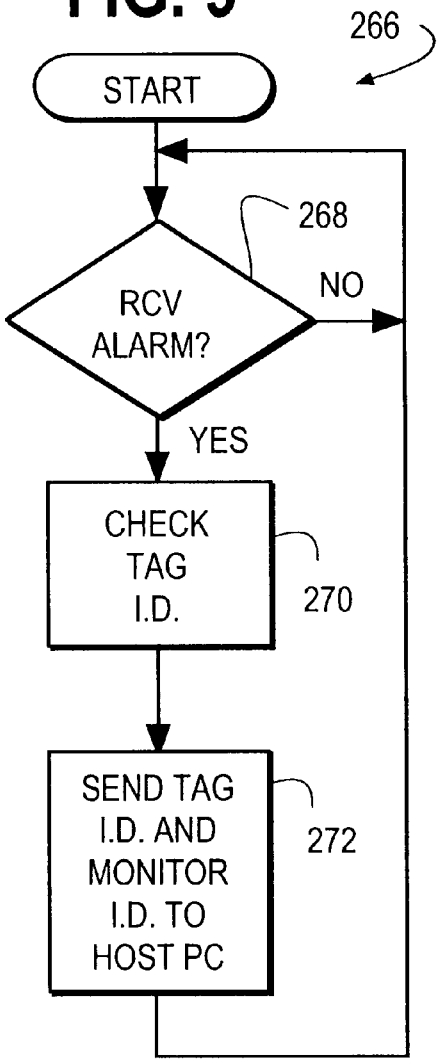
FIG. 9 is a flow chart of the monitor routine for checking for a tag initiated alarm signal.

FIG. 9 discloses a monitor routine 266 for monitoring the transmission of an alarm signal by a tag. The routine 266 begins with Step 268 to determine whether an alarm signal was received. In the event an alarm was not received, the process is repeated. In the event an alarm signal is detected, the routine proceeds with Step 270 to check the received signal for the information identifying the tag. In the next Step 272, the routine 266 then sends the tag and monitor identification information to the host PC.

Figure 10:
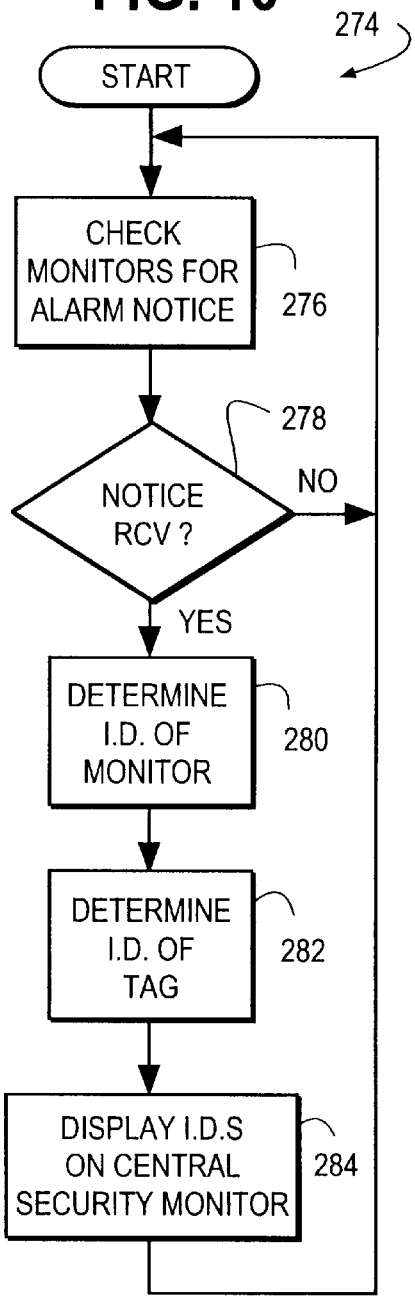
FIG. 10 is a flow chart of the host PC routine.

FIG. 10 discloses a routine 274 for the host PC. The routine 274 starts with Step 276 by checking monitors for an alarm notice. Step 278 determines whether an alarm notice is received. In the event an alarm notice is not received, the routine is repeated. In the event an alarm notice is received, Step 280 determines the identification of the monitor. Step 282, determines the identification of the tag. Alternatively, the routine can first check for the identification of the tag and thereafter the identification of the monitor. In any event, in Step 284, the monitor displays the alarm information on the central security monitor 38. The alarm information will indicate the general vicinity of the tag based on which monitor 20 detected the presence of the tag, and will also provide the identification information of the tag.

Figure 11:
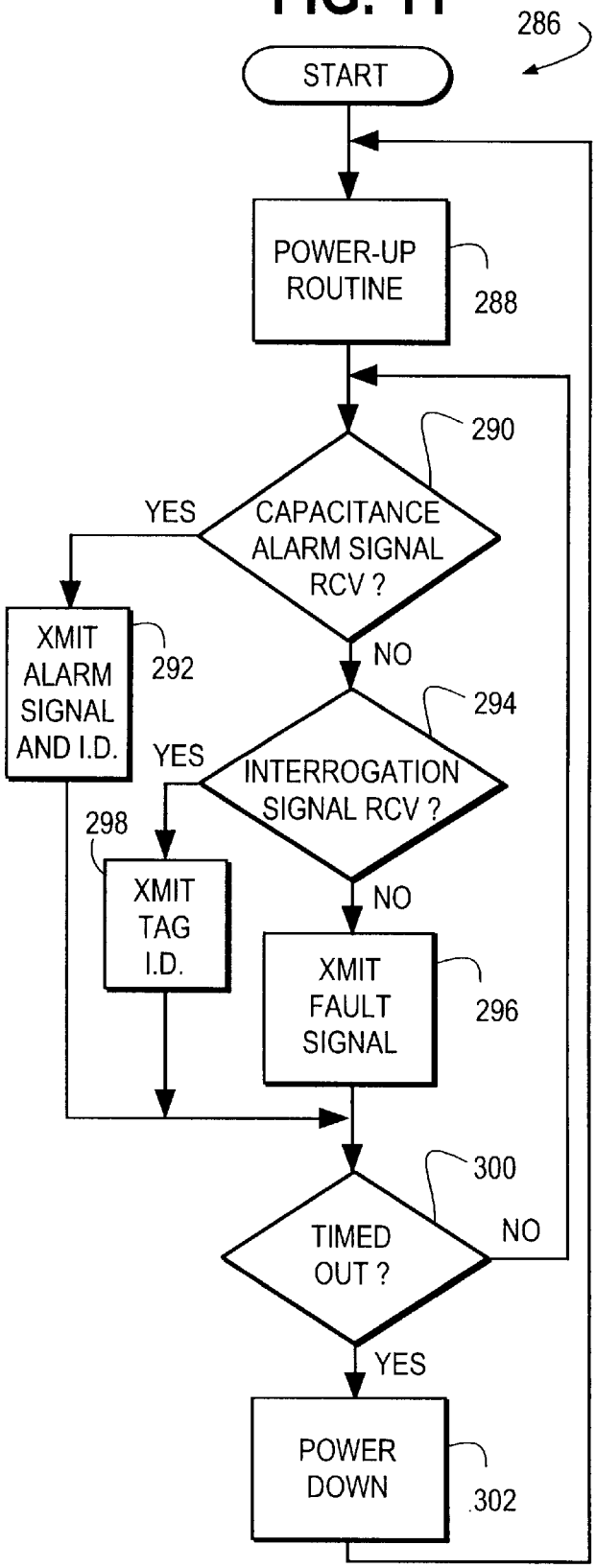
FIG. 11 is a flow chart of the tag routine.

FIG. 11 shows a tag routine 286. The routine begins with Step 288, a controller circuit power up routine. The power up routine includes setting the outputs of the microprocessor in order to maintain the power up condition of the controller circuit until a time out occurs within the controller circuit or the microprocessor determines a power down is in order, such as after completion of transmitting an alarm signal.

Step 290 of the routine determines whether the power up routine was initiated by the alarm circuit. In the event the alarm circuit initiated the routine, in Step 292 the controller circuit transmits an alarm signal and information identifying the tag. In the event the alarm circuit did not initiate the power up routine, in Step 294 the routine determines whether the power up routine was initiated as a result of the data stream detector circuit. In the event the data stream detector circuit did not initiate the power up routine, in Step 296 the micro controller transmits a fault signal at the output of the microprocessor. In the event the data stream detector circuit did initiate the power up routine, in Step 298 the micro controller transmits information identifying the tag at the output of the micro controller. In Step 300, the routine then determines whether a timeout as occurred or if it is otherwise appropriate to power down. In the event a timeout has not occurred, the routine repeats the process. In the event of a timeout, in Step 302 the micro controller executes a power down routine.

When the tag 12 is secured to a patient, the patient is in contact with the wristband 18 and the outer surface 44 of the wall 40 of the housing 14. The first and second electrodes 108, 110 are not in physical contact with the patient. Rather, the wall 40 of the housing separates the electrodes 108, 110 from the patient. In addition, the patient is further isolated from the electronic circuit 48 as the tag 12 includes a water-resistant sealed plastic housing.

With the outer surface 44 of the wall 40 of the housing 14 in contact with the patient, the RC time constant of the inverting branch is larger than the RC time constant of the branch feeding the non-inverting input 206 of the circuit and the comparator 202 will be stable and there will no oscillations at the output 114. However, in the event the tag 12 is removed from the patient, the RC time constant of the non-inverting branch is larger than the RC time constant of the branch feeding the inverting input 208 and the circuit will be unstable and the comparator 202 will develop an oscillating signal at the output 114.

Notwithstanding that the alarm circuit 200 is in continuous operation and the lithium battery 246 is sealed within the housing 14, the tag 12 provides a long useful life as a result of the two means for reducing the power consumption of the electronic circuit 48. In the first instance, the power provided to the alarm circuit 200 is derived from the output 100 of the oscillator 98. As noted above, the output 100 of the oscillator 98 is switching at relatively low frequency of approximately a few cycles per second. In addition, the duty cycle is preferably less than 50% to further reduce the average power consumed by the alarm circuit 200.

In addition, the power to the controller circuit 80 is switched off until either the frequency detector 118 detects an alarm condition or the data stream detector circuit 70 detects an interrogation signal from a monitor 20. Only then is power provided to the controller circuit 80. The controller circuit 80 has the ability to maintain its own power until an appropriate signal is transmitted via the tag transmitter 88 to the monitor 20.

The receiving strength of the monitor receiver 26 is greater than the receiving strength of the tag 12. As a result, while the monitors 26 may be able to receive the alarm signal from a tag 12, the tag 12 may not be within range of the same monitor 20 for receiving an interrogation signal. The range of the receivers and transmitters may be used in defining the patient authorized and unauthorized areas. In the event the patient and tag 12 are moved to an unauthorized area, a monitor 20 must be located within that unauthorized area within a range of the receiving strength of the tag receiver 58. In this way, the tag 12 will be assured to receive the interrogation signal from the monitor 20 and respond with a signal indicating the presence of the tag 12 (and patient) within an unauthorized area. The tag 12 will also provide the identification of the tag to the monitor 20. The monitor 20 can then relay the received information to the central security monitor 38 to alert the personnel that the patient and tag 12 have moved to an unauthorized location.

In addition, in the event the patient and tag 12 remain in an authorized location, but the tag 12 is removed from the patient, there must be at least one monitor within a receiving range of the alarm signal generated by the transmitter 88 of the tag 12. In this way, the monitor 20 will detect the alarm signal and the personnel will be alerted by the central security monitor 38 of a tag removal and the identification of the tag, as well as the approximate location of the tag 12 at the time of removal based on which monitor 20 or monitors 20 detected the alarm signal.

What is claimed is:

1. A tag for monitoring the security of a patient, the tag comprising:

a housing having a wall, the wall having an inner surface and an outer surface;

an electronic circuit located in the housing, the electronic circuit including an alarm circuit, including a capacitance measuring circuit, the capacitance measuring circuit having first and second electrodes, the first and second electrodes located adjacent the inner surface and in spaced relation from one another to form a capacitor, the alarm circuit having means for generating an alarm signal upon the capacitance measuring circuit detecting a level of capacitance corresponding to an alarm condition, whereby the outer surface of the housing is placed in contact with the patient, with the first and second electrodes capacitively coupled to the patient, but without the first and second electrodes in physical contact with the patient, the capacitance measuring circuit detects an alarm condition when the patient is no longer in contact with the outer surface of the tag.

2. The tag of claim 1, wherein the housing is a water-resistant plastic sealed housing, and includes a wrist band.

3. The tag of claim 1, wherein the housing is adapted to receive a lithium battery and the electronic circuit includes means for coupling to a lithium battery, whereby the electronics circuit is powered by the lithium battery.

4. The tag of claim 1, wherein the capacitance measuring circuit includes a comparator having a first input, a second input and an output, the first input is coupled to a first RC network which includes the capacitor formed by the first and second electrodes, the second input is coupled to a second RC network, the capacitance measuring circuit further having means for generating an oscillating signal at the output of the comparator upon detecting a change in the time constant of the first RC network, whereby the capacitance measuring circuit is capable of detecting when the tag is no longer in contact with a patient and generates the alarm signal.

5. The tag of claim 4, wherein the comparator is an operational amplifier having a non-inverting input and an inverting input, the first input is the non-inverting input, and the second input is the inverting input, and the oscillating generating means includes a first feedback circuit coupled between the comparator output and the non-inverting input, and a second feedback circuit coupled between the comparator output and the inverting input, the first feedback circuit includes the first RC network and the second feedback circuit includes the second RC network, the second RC network includes means for adjusting the offset between the non-inverting input and the inverting input to zero.

6. The tag of claim 4, wherein the electronic circuit includes a microprocessor and a transmitter means for transmitting an RF signal, the microprocessor having means for detecting the alarm signal and means for causing the transmitter means to transmit an RF signal indicating an alarm condition.

7. The tag of claim 6, wherein the alarm circuit includes a frequency detector having an input and an output, the input of the frequency detector is coupled to the output of the comparator, the output of the frequency detector generates an alarm signal when the frequency detector detects the oscillating signal at the output of the comparator, whereby the frequency detector generates an alarm signal when the patient is no longer in contact with the outer surface of the tag.

8. The tag of claim 7, wherein the output of the frequency detector is coupled to the microprocessor alarm signal detecting means, whereby the alarm signal at the output of the frequency detector triggers the microprocessor to cause the transmitting means to transmit in an RF signal indicating an alarm condition.

9. The tag of claim 8, wherein the tag is associated with an identification number and the RF signal transmitted by the transmitter mean includes the identification number.

10. The tag of claim 1, wherein the electronic circuit includes a first means for reducing the power consumption of the capacitance measuring circuit.

11. The tag of claim 10, wherein the capacitance measuring circuit includes a power input, and the first power consumption reducing means includes an oscillator having an output which is coupled to the power input of the capacitance measuring circuit, the output of the oscillator is preferably in the range of 1–50 hertz with a duty cycle of less than 80 percent, whereby the capacitance measuring circuit is turned on and off to reduce power consumption.

12. The tag of claim 11, wherein the output of the oscillator is in the range of 1–10 hertz with a duty cycle of 50 percent.

13. The tag of claim 1, wherein the electronic circuit includes a microprocessor and a second means for reducing the power consumption of the microprocessor.

14. The tag of claim 13, wherein the second power consumption reducing means includes a means for turning off the microprocessor during periods when an alarm signal is not generated and for turning on the microprocessor when an alarm signal is generated.

15. The tag of claim 14, wherein the second power consumption reducing means includes a means for controlling power, the power controlling means having an input coupled to the capacitance measuring circuit and an output, the microprocessor having a power input coupled to the output of the power controlling means, whereby the power controlling means turns on the microprocessor upon the generation of an alarm signal.

16. The tag of claim 13, wherein the microprocessor includes a power input and a data output, the electronic circuit includes a receiver means for receiving an RF signal, the receiver means having an input and an output, a means for detecting that the receiver means received a predetermined data stream, the detecting means having an input and an output, the input of the detecting means is coupled to the output of the receiver means, the second power consumption reducing means includes an input and an output, the input is coupled to the output of the detecting means, the output of the second power consumption reducing means is coupled to the power input of the microprocessor, the second power consumption reducing means includes means for turning off the microprocessor during the absence of an alarm condition and for turning on the microprocessor when the predetermined data stream is detected.

17. The tag of claim 16, wherein the electronic circuit includes transmitter means for transmitting an RF signal and an antennae, the transmitter means having an input and an output, the input is coupled to the data output of the microprocessor, and means for generating a data signal at the data output in response to detecting the predetermined data stream and for transmitting the data signal as an RF signal from the transmitter means.

18. A tag for monitoring the security of a patient, the tag comprising:

a housing having a wall, the wall having an outer surface and an inner surface;

a receiver antenna;

a receiver having an input and an output, the input coupled to the receiver antenna;

a means for detecting when the receiver receives a predetermined data stream via the receiver antenna, the detecting means having an input coupled to the output of the receiver, and an output;

a microprocessor having a data input, a data output and a power input;

a means for switching on and off the power to the power input, the switching includes a NAND gate means having a first control input, a second control input, and an output, the first control input is coupled to the output of the detecting means, the output is coupled to the power input;

a transmitter having an input and an output, the input is coupled to the data output of the microprocessor, a transmitter antenna, the transmitter antenna being coupled to the output of the transmitter, a capacitance measuring circuit having a first and second electrode located adjacent the inner surface and in spaced relation from one another to form a capacitor, a comparator having a first input, a second input, and an output, each input including an RC network, the capacitor forming part of the RC network for the first input, the comparator having means for developing an oscillating signal at the output the comparator when the comparator detects an offset between the first and second inputs of the comparator;

a frequency detector having an input and an output, the input is coupled to the output of the comparator, the output is coupled to the second control input of the switching means and to the detecting means;

whereby the power to the microprocessor is switched off until the detection of either a received predetermined signal or an alarm condition, whereupon the transmitter transmits an RF signal to indicate that either the tag has been removed from the patient or that the tag has entered an unauthorized zone.

19. The tag of claim 18, wherein the detecting means includes a counter and means for counting the number of pulses in a data stream from the receiver within a predetermined period, and the switching means includes a NAND gate having an output coupled to the power input of the microprocessor.

20. A system for monitoring the security of a patient, the system including a tag capable of being placed in contact with and secured to a patent, the system comprising:

at least one monitor, each of the at least one monitor to be located in the proximity of a respective one of at least one restricted area, each of said at least one monitor having transmitter means for transmitting an interrogation signal and receiver means for receiving a signal;

a tag including, a housing, the housing having a wall, the wall having an inner surface and an outer surface, an electronic circuit located in housing, the electronic circuit including a receiver means for receiving an interrogation signal, an alarm circuit including a capacitance measuring circuit, the capacitance measuring circuit having first and second electrodes, the first and second electrodes located adjacent the inner surface and in spaced relation from one another to form a capacitor, the alarm circuit having means for generating an alarm signal upon the capacitance measuring circuit detecting a level of capacitance corresponding to an alarm condition, the electronic circuit having a transmitter means for transmitting a signal upon either the generation of the alarm signal or the receiver means receiving an interrogation signal, whereby the outer surface of the housing is placed in contact with the patient, with the first and second electrodes capacitively coupled to the patient but without the first and second electrodes in physical contact with the patient, the capacitance measuring circuit detects an alarm condition when the patient is no longer in contact with the outer surface of the tag, the tag will notify the one monitor whenever the tag housing is no longer in contact the patient or when the tag enters a restricted area in which the one monitor is located.

21. The system of claim 20, wherein the signal transmitted by the transmitter means includes information identifying the tag.

22. The system of claim 20, further comprising:

a network coupled to the at least one monitor, a host computer coupled to the network;

a security monitor coupled to the host computer, whereby the security monitor displays information corresponding to alarm signals transmitted by a tag, the identification of the tag, and the general location of the tag corresponding to the restricted area of the respective monitor which received the signal from the tag.

23. The system of claim 20 wherein the electronic circuit includes a microprocessor and a means for reducing the power consumption of the microprocessor.

24. The system of claim 23, wherein the power consumption reducing means includes means for turning off the microprocessor during periods when an alarm signal is not generated and for turning on the microprocessor when an alarm signal is generated.

25. The system of claim 24, wherein the power consumption reducing means includes a means for controlling power, the power controlling means having an input coupled to the capacitance measuring circuit and an output, the microprocessor having a power input coupled to the output of the power controlling means, whereby the power controlling means turns on the microprocessor upon the generation of an alarm signal.

26. The system of claim 23, wherein the microprocessor includes a power input and a data output, the tag receiver means having an input and an output, the electronic circuit includes a means for detecting that the tag receiver means received a predetermined data stream, the detecting means having an input and an output, the input of the detecting means is coupled to the output of the tag receiver means, the power consumption reducing means includes an input and an output, the input is coupled to the output of the detecting means, the output of the power consumption reducing means is coupled to the power input of the microprocessor, the power consumption reducing means includes means for turning off the microprocessor during the absence of an alarm condition and for turning on the microprocessor when the predetermined data stream is detected.

27. The system of claim 26, wherein the transmitter means includes means for transmitting an RF signal and an antennae, the transmitter means having an input and an output, the input is coupled to the data output of the microprocessor, the electronic circuit includes means for generating a data signal at the data output in response to detecting the predetermined data stream and for transmitting the data signal as an RF signal from the transmitter means.

* * * * *